US009316980B2

(12) United States Patent
Miyahara

(10) Patent No.: US 9,316,980 B2
(45) Date of Patent: Apr. 19, 2016

(54) IMAGE FORMING APPARATUS AND IMAGE FORMATION METHOD THAT PAPER DOES NOT STOP IN REGISTRATION ROLLER POSITION

(71) Applicant: KYOCERA Document Solutions Inc., Osaka (JP)

(72) Inventor: Norifumi Miyahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/633,698

(22) Filed: Feb. 27, 2015

(65) Prior Publication Data

US 2015/0241827 A1 Aug. 27, 2015

(30) Foreign Application Priority Data

Feb. 27, 2014 (JP) ..... 2014036235
Feb. 27, 2014 (JP) ..... 2014036236

(51) Int. Cl.
*G03G 15/00* (2006.01)

(52) U.S. Cl.
CPC ..... *G03G 15/50* (2013.01); *G03G 15/5004* (2013.01); *G03G 15/6564* (2013.01); *G03G 2215/00603* (2013.01)

(58) Field of Classification Search
CPC ..... G03G 15/01; G03G 15/2039; G03G 15/2042; G03G 15/5004; G03G 15/502; G03G 15/5087; G03G 2215/0177; G03G 9/0819; G03G 9/0821; G03G 9/08782; G03G 15/08; G03G 15/2032; G03G 15/2053
See application file for complete search history.

(56) References Cited

U.S. PATENT DOCUMENTS

| | | | | |
|---|---|---|---|---|
| 6,172,762 | B1 | 1/2001 | Uchiyama | |
| 2007/0047993 | A1 | 3/2007 | Brinsley | |
| 2011/0135335 | A1* | 6/2011 | Miura | 399/70 |
| 2012/0224224 | A1 | 9/2012 | Furumoto et al. | |
| 2014/0112671 | A1* | 4/2014 | Hamaya et al. | 399/13 |

FOREIGN PATENT DOCUMENTS

| | | | |
|---|---|---|---|
| EP | 2667256 | A2 | 11/2013 |
| JP | S56-137365 | A | 10/1981 |
| JP | 2004-262026 | A | 9/2004 |
| JP | 2008-009216 | A | 1/2008 |
| JP | 2012-123268 | A | 6/2012 |

* cited by examiner

*Primary Examiner* — Roy Y Yi
(74) *Attorney, Agent, or Firm* — Hawaii Patent Services; Nathaniel K. Fedde; Kenton N. Fedde

(57) ABSTRACT

Provided is an image forming apparatus made to shorten time of a first copy (first page copy of a manuscript.) In the image forming apparatus, primary feeding (feeding from a sheet paper cassette to a resist position roller) and secondary feeding (feeding from a resist position roller) are performed continuously. When a first copy is performed, based on warm-up information, print engine, such as a feed roller, a transfer part, a fixing part, and an ejection roller, is set up. Paper will be fed when the setup is completed. The setup of print engine that performs operation required for printing is performed before feeding by using the warm-up information. Therefore, the time of the first copy is shortened.

6 Claims, 5 Drawing Sheets

IMAGE FORMING APPARATUS AND IMAGE FORMATION METHOD THAT PAPER DOES NOT STOP IN REGISTRATION ROLLER POSITION

INCORPORATION BY REFERENCE

This application is based on and claims the benefit of priority from Japanese Patent Application No. 2014-036236 filed on Feb. 27, 2014 and 2014-036235 filed on Feb. 27, 2014, the contents of which are hereby incorporated by reference.

BACKGROUND

The present disclosure is related to an image forming apparatus and an image formation method that control an engine that prints an image of a manuscript on a paper (henceforth "print engine.")

Typical image forming apparatuses, such as a printer or an MFP (Multifunctional Peripheral), pick out a paper from a sheet paper cassette and stop a paper with registration rollers. Accordingly, feeding operation is performed from a sheet paper cassette to a registration roller position (henceforth "primary feeding.") Also, the image forming apparatus performs another feeding operation for printing an image from a registration roller position (henceforth "secondary feeding").

In short, feeding operation is separated into two operations. In this way, by stopping the paper with the registration rollers, a setup of the print engine that prints an image on the paper after primary feeding can be performed. Also, secondary feeding can be performed after the setup of print engine is completed. Also, the image forming apparatus that stops a paper in such a registration roller position makes setup information for performing the required setup to print engine after primary feeding. In this case, the image forming apparatus performs the setup of print engine based on this setup information.

When the setup of print engine is completed, the image forming apparatus performs the secondary feeding and prints the image of a manuscript on the paper. In this case, the setup to print engine required after primary feeding is performed. Accordingly, when printing the manuscript on condition determined previously, time of copying a first page of the manuscript (henceforth a "first copy") can be shortened.

SUMMARY

An image forming apparatus of the present disclosure is an image forming apparatus that a paper does not stop in a registration roller position.

The image forming apparatus includes a print engine control part and a warm-up information preparing part. The print engine control part controls operation of print engine. The warm-up information preparing part makes warm-up information. The print engine control part sets up the print engine based on the warm-up information made by the warm-up information preparing part before feeding.

Also, an image forming apparatus includes a print engine control part, a warm-up information preparing part, a cancel input part, and a cancel input determining part. The print engine control part controls operation of print engine. The warm-up information preparing part makes warm-up information. The cancel input part inputs cancel for the printing request. The cancel input determining part determines whether or not the cancel is inputted. When it determines with the cancel being inputted by the cancel input determining part, the print engine control part cancels a setup state of the print engine set up based on the warm-up information made by the warm-up information preparing part before feeding.

Also, an image formation method of the present disclosure is an image formation method performed by an image forming apparatus that a paper does not stop in a registration roller position. In this image formation method, operation of print engine is controlled, warm-up information is made, and the print engine is set up based on the made warm-up information before feeding.

DETAILED DESCRIPTION

[First Embodiment]

Figure 1:
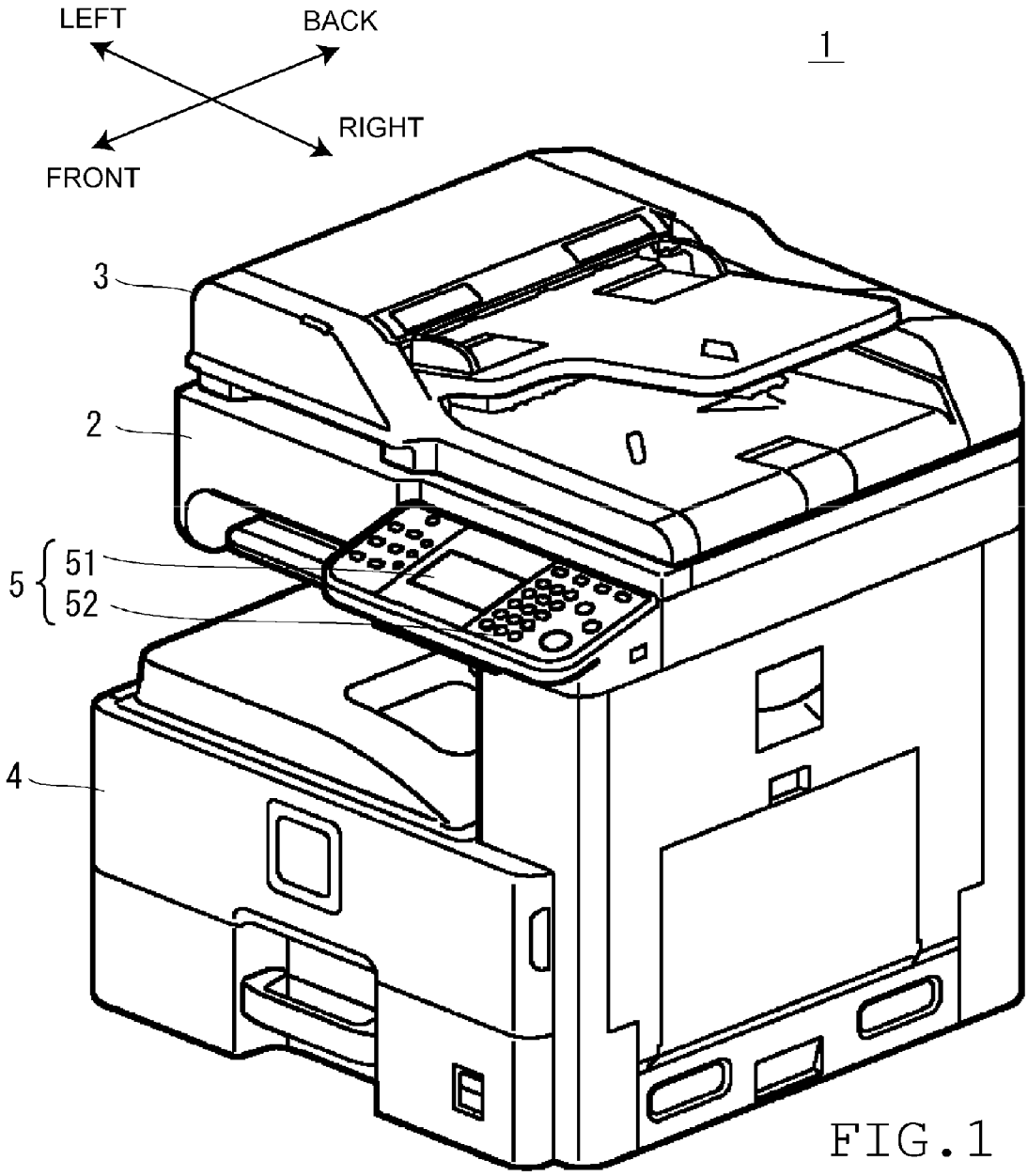
FIG. 1 is a perspective view illustrating an external configuration of an image forming apparatus related to a first embodiment or a second embodiment of the present disclosure.
Figure 2:
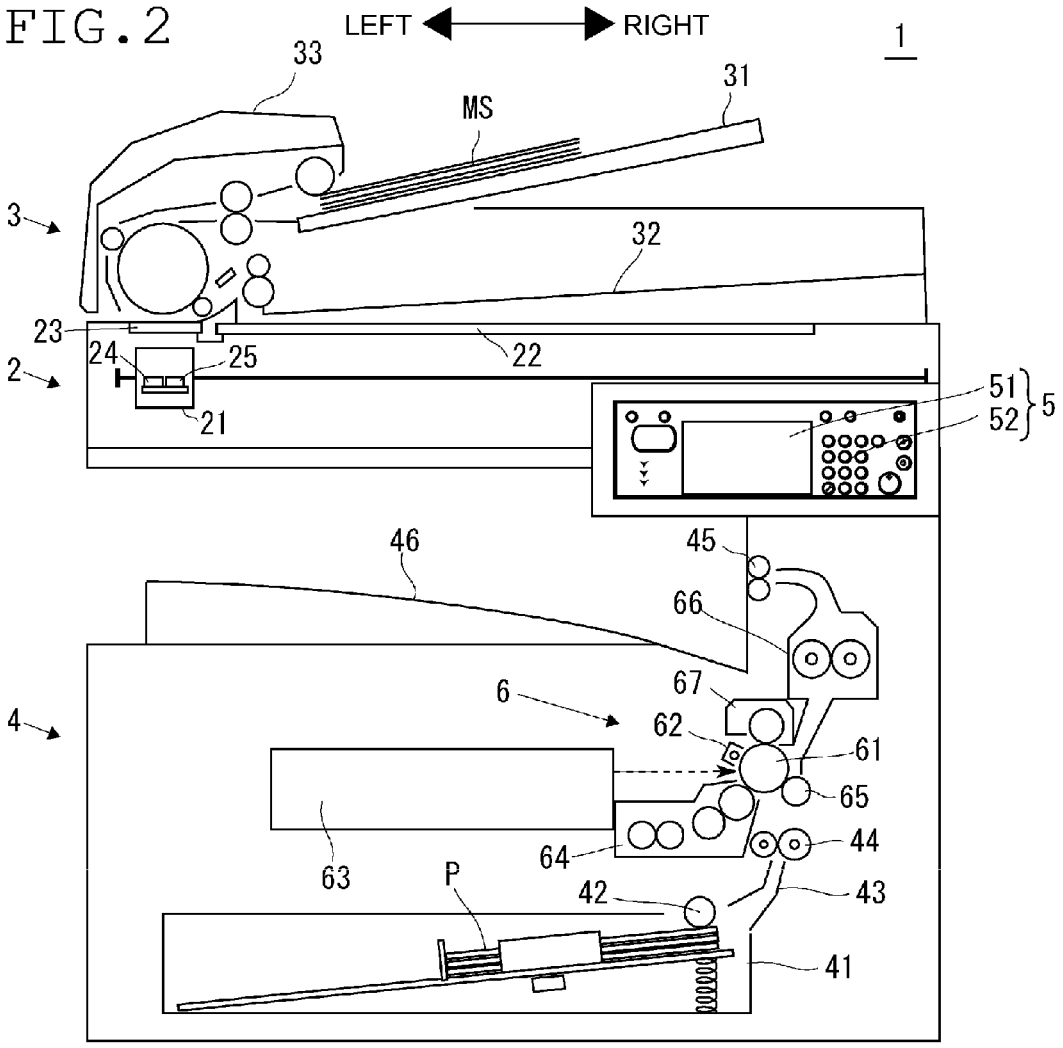
FIG. 2 is a sectional view illustrating an internal configuration of the image forming apparatus related to the first embodiment or the second embodiment.

FIG. 1 is a figure showing an external configuration of the image forming apparatus related to the first embodiment in the present disclosure. FIG. 2 is a figure showing an internal configuration of the image forming apparatus related to the first embodiment in the present disclosure. Image forming apparatus 1 of the first embodiment is, for example, a printer, an MFP, or the like. Image forming apparatus 1 includes manuscript reading part 2, manuscript feeding part 3, body part 4, and operation part 5. Manuscript reading part 2 is allocated in an upper part of body part 4. Manuscript feeding part 3 is allocated in an upper part of manuscript reading part 2.

Such the image forming apparatus 1, before primary feeding, makes information about a warm-up for print engine, which is need for printing that a user has a printing request (henceforth "warm-up information.") Also, image forming apparatus 1 sets up print engine based on this warm-up information. Accordingly, image forming apparatus 1 performs a first copy.

Warm-up information here is feeding paper source information, discharging destination information, blank information, color information, or the like. The feeding paper source information is information for a source of feeding paper, paper size, a paper type, or the like. The source feeding paper is a sheet paper cassette, a paper feed tray, an intermediate tray for double-side printings, or the like. The discharging destination information is information for a discharging destination. The discharging destination is a discharging tray, a mail box, an intermediate tray for double-side printings, or the like. The blank information is information for being blank paper printing. The color information is information for which toner color is used.

Operation part 5, which is for setting up of image forming apparatus 1 and instructing operation, is allocated in a front side of image forming apparatus 1. Operation part 5 is a device that includes liquid crystal display part 51 and manual operation button 52. If a user operates operation part 5, instructions are input. Accordingly, a user sets up various kinds of setting in image forming apparatus 1. Also, the user makes perform various functions, such as image formation of image forming apparatus 1. Liquid crystal display part 51 is a device that shows a state of image forming apparatus 1, an image formation situation and number of prints, or performs various setup. Liquid crystal display part 51 is, as a touch panel, various setup of function, such as double-side printing, a tone reversal, or the like, various setup, such as a magnification setup, a concentration setup, or the like, is possible. As manual operation button 52, a start button, a stop/clear button, a reset button, a numeric keypad, or the like, are included. The start button is for instructing start of image formation. The stop/clear button is for instructing stop of image formation, or the like. The reset button is used for resetting the various setup of image forming apparatus 1 into a default state.

As refer to FIG. 2, manuscript reading part 2 includes scanner 21, platen glass 22, and manuscript reading slit 23. Scanner 21 has light source 24 and light receiving part 25. Scanner 21 is configured movable for a transportation direction of manuscript MS (manuscript) by manuscript feeding part 3. Manuscript reading slit 23 is a slit formed in a direction that intersects perpendicularly with the transportation direction of manuscript MS by manuscript feeding part 3.

Manuscript feeding part 3 is a device that includes manuscript mounting part 31, manuscript discharge part 32, and manuscript transport mechanism 33. Manuscript MS set to manuscript mounting part 31 feed outs one sheet at a time by manuscript transport mechanism 33. Manuscript MS is conveyed in a position that faces manuscript reading slit 23. After that, manuscript MS is discharged by manuscript discharge part 32. Also, manuscript feeding part 3 and manuscript reading part 2 are connected by a hinge mechanism on aback side of image forming apparatus 1. Therefore, manuscript feeding part 3 operates as a platen cover that opens and closes an upper surface of platen glass 22. By opening up manuscript feeding part 3, an upper surface of platen glass 22 is opened. In this case, it will be in a state where manuscript MS can be set to platen glass 22.

Operation of scanner 21 is explained in a state where manuscript MS is not set to manuscript mounting part 31, and in an opened state where manuscript feeding part 3 (platen cover) is opened, First, reading of manuscript MS is instructed with manual operation button 52 of operation part 5. Then, manuscript MS set to platen glass 22 is read. In cases where it reads manuscript MS placed in platen glass 22, scanner 21 is moved to the position that faces platen glass 22. Scanner 21 reads manuscript MS set to platen glass 22 with scanning from vertical scanning direction datum line B to the vertical scanning direction that intersects perpendicularly with a scanning direction and acquires image data. Scanner 21 outputs the acquired image data to control part 7 (FIG. 3) in body part 4.

The operation of scanner 21 in the state where manuscript MS is set to manuscript mounting part 31 is explained. First, reading of manuscript MS is instructed with manual operation button 52 of operation part 5. Then, manuscript MS conveyed by manuscript feeding part 3 is read. Manuscript MS is turned up a front surface (a side that reads a manuscript image) and is set to manuscript mounting part 31. Then, manuscript MS set to manuscript mounting part 31 is conveyed by manuscript feeding part 3 from left side. In this case, the front surface of manuscript MS is led to a position that faces manuscript reading slit 23. Also, scanner 21 is moved to the position that faces manuscript reading slit 23 in cases where it reads manuscript MS conveyed by manuscript feeding part 3. Scanner 21 reads manuscript MS from manuscript reading slit 23 with synchronizing conveying action by manuscript feeding part 3 and acquires image data. Scanner 21 outputs the acquired image data to control part 7 (FIG. 3) in body part 4.

Body part 4 is provided with printing part 6, and it is provided with feeding part 41, feed roller 42, paper sheet conveying path 43, resist position roller 44, and ejection roller 45.

Typically, the registration roller is controlled by actuators (not illustrated,) such as a driving motor. On the other hand, in the present embodiment, the actuator is omitted, and thus it is performed the cost of image forming apparatus is reduced. That is, a roller in the position of the registration roller in the present embodiment does not have resist function to specify timing for feeding. Therefore, the roller in the position of the registration roller is called resist position roller 44. In addition, resist position roller 44 is, for example, directly linked with actuators, such as feed roller 42, and is controlled by the actuator that drives feed roller 42, or the like.

Feeding part 41 is a sheet paper cassette that two or more sheets of paper P are contained. Feed roller 42 feed outs one sheet of paper P at a time to paper sheet conveying path 43 from feeding part 41. Paper P fed out to paper sheet conveying path 43 with feed roller 42 is conveyed to printing part 6 by resist position roller 44. Resist position roller 44 conveys paper P so that head of paper P supplied from the sheet paper cassette and head of an image read in the manuscript is matched. Then, paper P, which is recorded by printing part 6, is discharged to ejection space 46 by ejection roller 45. Ejection space 46 is formed between manuscript reading part 2 and body part 4. Thus, feed roller 42, resist position roller 44, and ejection roller 45 operate as a conveyance part of paper P. In addition, feeding part 41 shown in FIG. 2 is illustrated as installed one sheet paper cassette. However, this is an example, and, in feeding part 41, it is possible to install the sheet paper cassette having a plurality of feed stages where a paper in which paper sizes differ can be set. Also, it is also possible to have another feeding source in addition to feeding part 41. Also, it is possible to install another discharging destination in ejection space 46.

Printing part 6 is a print engine that includes photo conductor drum 61, charging part 62, exposure part 63, image formation part 64, transfer part 65, fixing part 66, and cleaning part 67. Exposure part 63 is an optical unit having a laser device, a mirror, or the like. Exposure part 63 outputs and exposes laser beam based on image data to photo conductor drum 61, which is uniformly electrified by charging part 62. Accordingly, an electrostatic latent image is formed on a surface of photo conductor drum 61. Image formation part 64 is a development unit that develops the electrostatic latent image formed on photo conductor drum 61 by using the toner and makes the toner image based on the electrostatic latent image form on photo conductor drum 61. Transfer part 65 makes transfer the toner image formed on photo conductor drum 61 by image formation part 64 to paper P. Fixing part 66 heats paper P in which the toner image is transferred by transfer part 65 and makes fix the toner image to paper P. Then, toner that remains on photo conductor drum 61 is removed by cleaning part 67.

Figure 3:
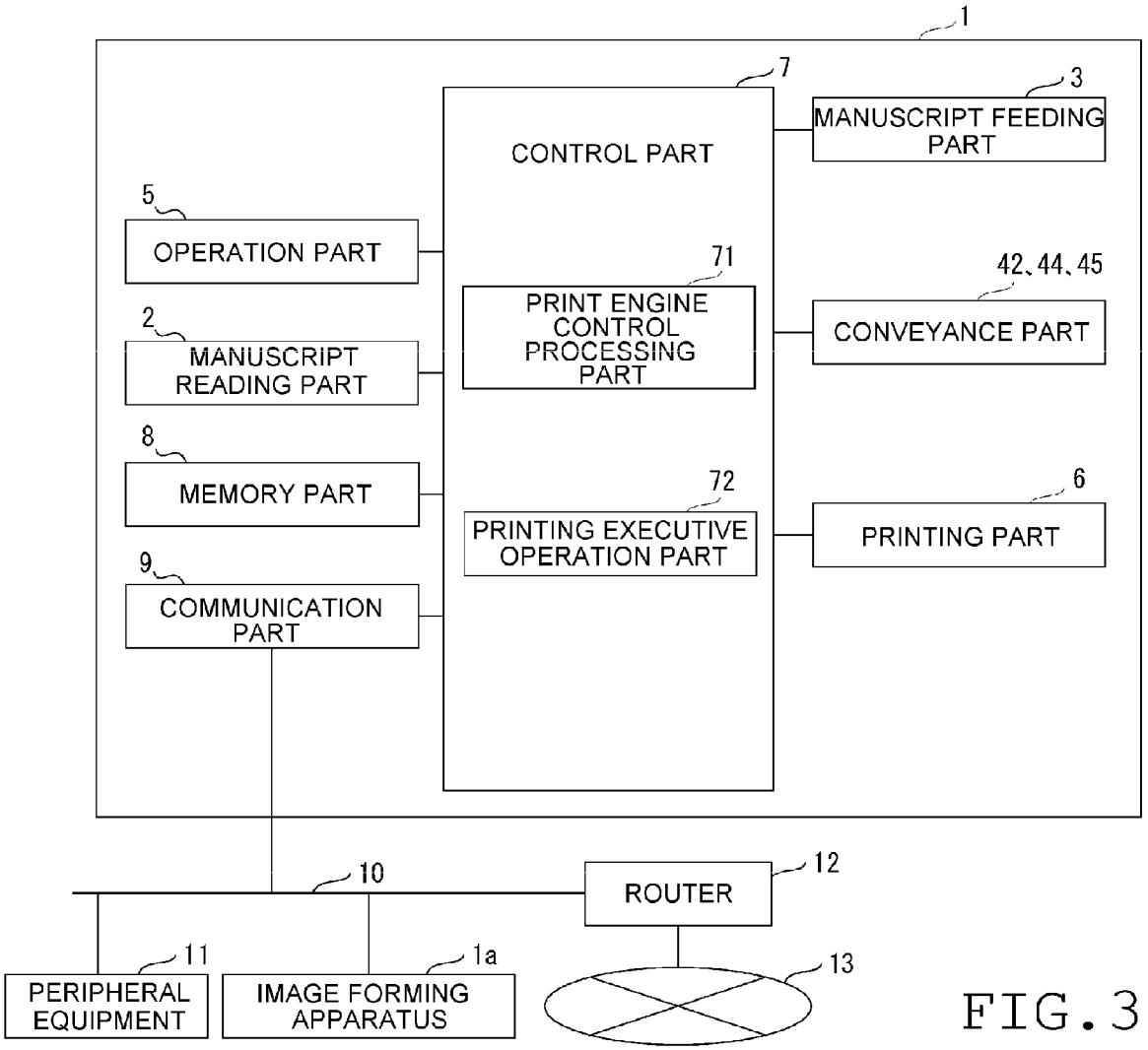
FIG. 3 is a block diagram illustrating a functional block configuration of the image forming apparatus related to the first embodiment or the second embodiment.

FIG. 3 is a figure illustrating a functional block configuration of the image forming apparatus related to the first embodiment in the present disclosure. Above-mentioned manuscript reading part 2, manuscript feeding part 3, conveyance part (feed roller 42, resist position roller 44, ejection roller 45), operation part 5, printing part 6, memory part 8, and communication part 9 are connected to control part 7. Each part is operation-controlled by control part 7.

Control part 7 has print engine control processing part 71 and printing executive operation part 72.

Control parts 7 is an information processing circuit, such as a microcomputer having ROM (Read Only Memory), RAM (Random Access Memory), or the like. The control program for controlling operation of image forming apparatus 1 is memorized in ROM. Control part 7 is a circuit that reads the control program memorized in ROM and makes expand the control program to RAM. Accordingly, control part 7 controls a whole device according to specified instructions information inputted from operation part 5. Print engine control processing part 71 is a circuit operation-controls a print engine having in image forming apparatus 1 by instructions from control part 7. Printing executive operation part 72 is a circuit that performs print operation by instructions from control part 7.

Memory parts 8 is a memory circuit, such as semiconductor memory or HDD (Hard Disk Drive), the image data of manuscript MS read by scanner 21 is memorized, and various kinds of management information and setup information are memorized.

Communication part 9 is a circuit that transmits and receives various data between peripheral equipment 11, such as PC (personal computer), and other image forming apparatuses la via networks 10, such as LAN. Also, it is configured that communication part 9 is connectable with Internet 13 via network 10 and router 12. Then, communication part 9 has a function that transmits and receives various data among the various communication equipment connected to Internet 13.

Figure 4:
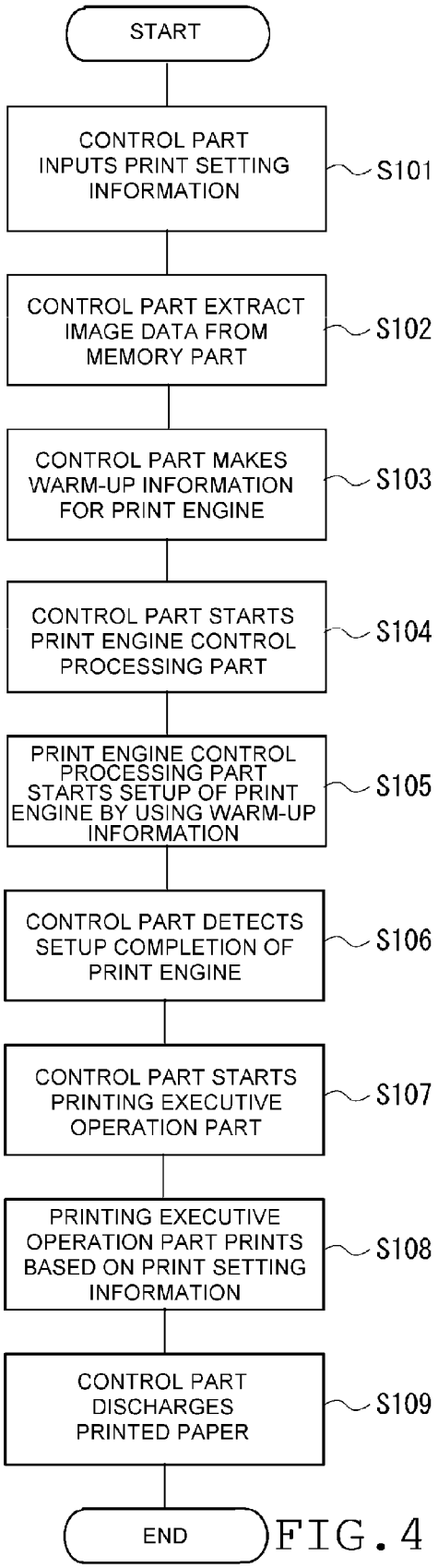
FIG. 4 is a flow chart that illustrates the printing procedure in a first copy related to the first embodiment.

Then, a printing procedure in the first copy in image forming apparatus 1 is explained by using a flow chart shown in FIG. 4.

Here, image forming apparatus 1 cannot stop paper P in the position of resist position roller 44 of primary feeding (feeding from the sheet paper cassette to resist position roller 44) and secondary feeding (feeding from resist position roller 44.) That is, in image forming apparatus 1, primary feeding and secondary feeding are carried out continuously.

A user sets manuscript MS to manuscript mounting part 31 of manuscript feeding part 3. By using manual operation button 52 of operation part 5, the user inputs setup information (henceforth "print setting information") and makes a printing request. Print setting information has the manuscript size of manuscript MS to read, the paper size of paper P to print, the color mode of a monochrome printing or color printing, or the like.

FIG. 4 is a flow chart that shows the printing procedure in the first copy related to the first embodiment.

(Step S101)

First, control part 7 inputs the print setting information that the user set up from operation part 5.

(Step S102)

Next, control part 7 extracts the image data of manuscript MS that scanner 21 read from memory part 8.

(Step S103)

Next, control part 7 makes the warm-up information for the print engine. Control part 7 makes this warm-up information based on print setting information inputted at Step S101, manuscript size read by manuscript reading part 2, the image data inputted in Step S102, or various kinds of management information and setup information memorized in memory part 8.

For example, the feeding paper source information that is warm-up information is made by using information of the print setting information, feed size that the management information kept in memory part 8, or read manuscript size, or paper size based on the sheet paper cassette automatically selected based on the manuscript size, a paper type, or the like.

Also, the discharging destination information that is warm-up information is made by using information of the discharging destination, or the like, kept in the print setting information or the management information of memory part 8. Also, the blank information and color information that are warm-up information are made by using the color mode of print setting information and the image data.

In a typical image forming apparatus that a paper stops in the registration roller position, after primary feeding, with the warm-up information for print engine, for example, post conditioning information, count-up information, charging information, or the like, are notified to print engine. Post conditioning information is information including existence of post conditioning, a type of post conditioning, whether bundle discharge of the paper is performed or not, or the like. Count-up information is information on whether it counts up or not. Charging information is information including unit price information according to paper, or the like.

As compared with this, in the image forming apparatus that the paper does not stop in the registration roller position in the present embodiment, the above-mentioned information without regards to the drive of printing part 6 or various rollers directly may be notified after the notice of warm-up information. Accordingly, the notice time of warm-up information is shortened. As a result, the engine setup is completed quickly. Further, first copying time can be shortened.

(Step S104)

Next, control part 7 starts print engine control processing part 71.

(Step S105)

Next, print engine control processing part 71 starts the setup of print engine based on the warm-up information.

For example, it performs operation-controlling that drives the engine of feeding part 41 and feed roller 42 corresponded to the feeding paper source information of the warm-up information. Also, it performs operation controlling that drives the engine of ejection roller 45 corresponded to the discharging destination information of the warm-up information. Also, it performs operation controlling that sets up temperature of fixing part 66 by the paper size of paper P set to feeding part 41. Also, it performs control that sets up a developing bias of image formation part 64, or the like, by the blank information and color information of the warm-up information.

(Step S106)

Next, control part 7 detects completion of the setup of print engine from print engine control processing part 71.

(Step S107)

Next, control part 7 starts printing executive operation part 72.

(Step S108)

Next, printing executive operation part 72 takes out paper P from feeding part 41 based on the print setting information inputted in Step S101. Also, printing executive operation part 72 makes perform the print operation. This print operation is that transfer part 65 makes transfer a toner image to paper P, and fixing part 66 heats paper P and fixes a toner image to paper P.

(Step S109)

Next, control part 7 discharges paper P, which the toner is fixed, to ejection space 46 by ejection roller 45.

As mentioned above, in the image forming apparatus of a first embodiment, the motor for registration rollers is omitted for the purpose of the cost reduction. That is, in the image forming apparatus, even if the roller exists in a registration roller position, the paper does not stop in the registration roller position. In such the image forming apparatus, the primary feeding and the secondary feeding is operated, continuously. Therefore, the setup of the print engine cannot be performed between the primary feeding and the secondary feeding. Therefore, in the image forming apparatus that a paper does not stop in the registration roller position, time of the first copy cannot be shortened.

Accordingly, in the image forming apparatus of the first embodiment, the print engine is set up based on warm-up information, and the paper will be fed when the setup of the print engine is completed. Thus, since the setup of the print engine that performs operation required for printing is completed before feeding, even in cases where the paper does not stop in the registration roller position, the time of the first copy can be shortened.

[Second Embodiment]

In the external configuration (FIG. 1), the internal configuration (FIG. 2), and the functional block configuration (FIG. 3) in the image forming apparatus in the second embodiment are similar to those in the first embodiment.

The image forming apparatus of the first embodiment that the paper does not stop in the registration roller position makes the information (warm-up information) for performing the required warm-up to print engine before feeding. The image forming apparatus sets up the print engine required for printing based on the warm-up information, paper is fed when the setup of print engine is completed, and thus printing speed is increased.

However, in the state during the setup of print engine or being completed the setup (henceforth a "setup state"), when paper is not fed and the printing request is canceled by the user, print engine keeps the setup state until the next printing request is received, and thus, for example, it continues consuming electric power.

This is because, in the control of print engine, although the notice of cancel is performed to the print engine in cases where a paper is conveying, the notice of cancel is not performed to the print engine in cases where a paper is not conveying.

In addition, in a typical image forming apparatus that the paper stops in the registration roller position, after primary feeding, the setup of the print engine is completed based on warm-up information. Accordingly, primary feeding is completed even if the printing request is canceled in the state of the setup (a paper is conveying). Therefore, the notice of cancel is performed to the print engine, and the setup state based on warm-up information is canceled.

For example, in the image forming apparatus of the first embodiment that the paper does not stop in the registration roller position, a setup state can be canceled by a timer. However, since there is no telling when the next printing request comes, sufficient timer time is needed to have. Therefore, when the printing request is canceled in the setup state, it consumes electric power uselessly.

Consequently, image forming apparatus 1 in the second embodiment makes the warm-up information for print engine required for printing in which the user has the printing request before primary feeding. Then, print engine is set up based on this warm-up information. In addition, it has a cancel input part as a cancel input circuit that inputs cancel to the printing request. Also, it has a cancel input determining part as a cancel input determining circuit that determines whether the cancel is input or not.

Figure 5:
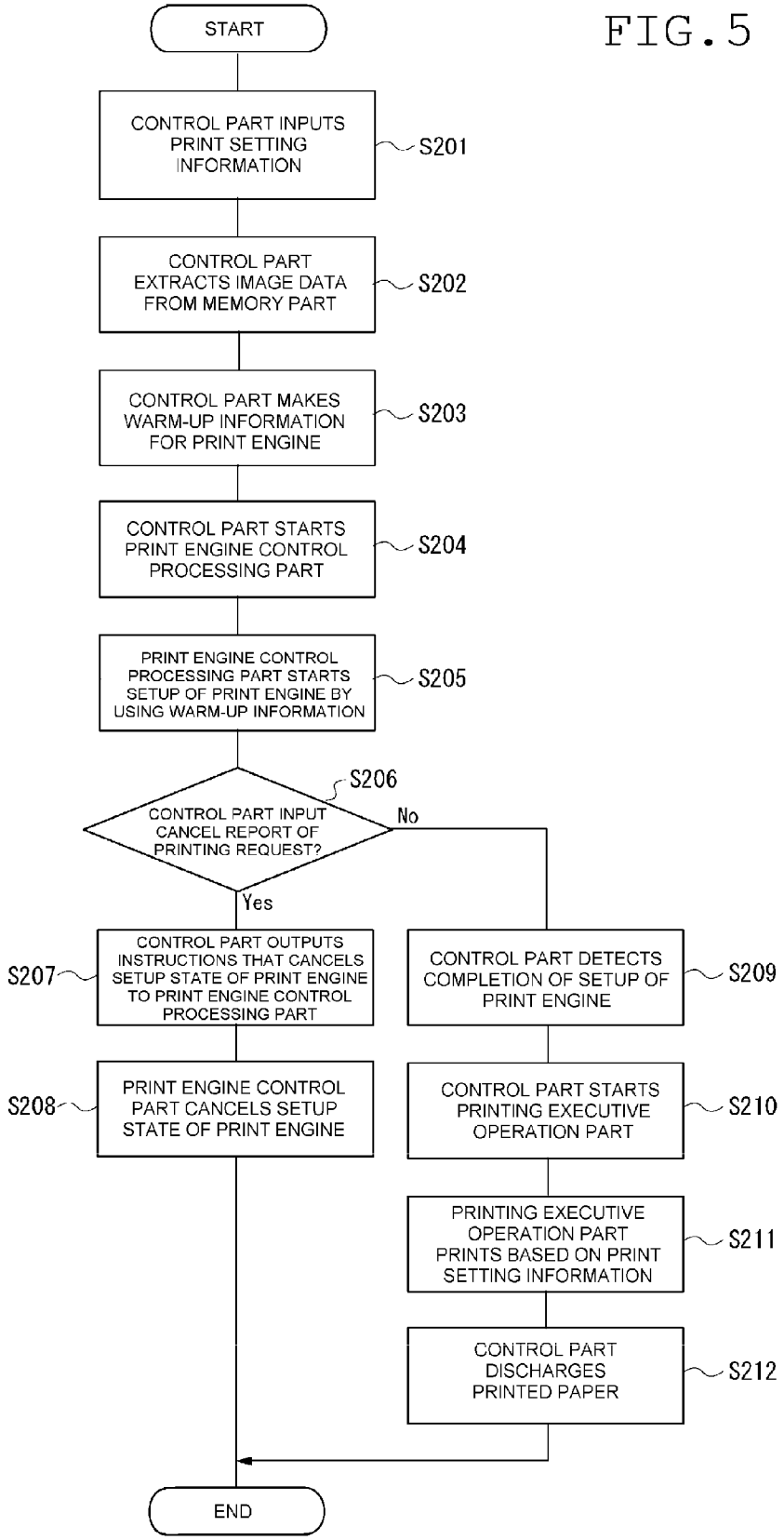
FIG. 5 is a flow chart that illustrates the printing request cancel process in the first copy related to the second embodiment.

FIG. 5 is a flow chart that shows the printing request cancel procedure in the first copy related to the second embodiment.

On the conditions of the first copy, a user sets manuscript MS to manuscript mounting part 31 of manuscript feeding part 3. After the user inputs print setting information and makes a printing request with manual operation button 52 of operation part 5, he or she sets up cancel of the printing request by using operation part 5. Operation part 5 outputs a cancel report to control part 7, when cancel of the printing request is set up. Control part 7 inputs the cancel report.

(Step S201)

First, control part 7 inputs the print setting information that the user set up by using operation part 5.

(Step S202)

Next, control part 7 extracts an image data of manuscript MS, which is read by scanner 21, from memory part 8.

(Step S203)

Next, control part 7 makes warm-up information of print engine based on print setting information input in Step S201, size of manuscript read by manuscript reading part 2, image data input in Step S202, or various kinds of management information and setup information memorized in memory part 8.

For example, the feeding paper source information that is warm-up information is made by using information, such as the print setting information, feed size that is kept in the management information in memory part 8, or read manuscript size, or paper size and a paper type based on the sheet paper cassette automatically selected based on manuscript size.

Also, the discharging destination information that is warm-up information is made by using information, such as the print setting information, or the discharging destination kept in the management information in memory part 8. Also, the blank information and color information of warm-up information are made by using the color mode of the print setting information and the image data.

In the image forming apparatus which a paper does not stop in the registration roller position of the present embodiment, about the post conditioning information, the count-up information, and the charging information, or the like, these may be notified after the notice of warm-up information. These are not concerned driving printing part 6 or various rollers, directly. This is the same as that of the above-mentioned first embodiment. Thereby, the notice time of the warm-up information is shortened, the engine setup is completed quickly, and further first copying time can be shortened.

(Step S204)

Next, control part 7 starts print engine control processing part 71.

(Step S205)

Next, print engine control processing part 71 starts the setup of print engine based on the warm-up information. For example, it performs operation-controlling that drives the engine of feeding part 41 and feed roller 42 corresponded to the feeding source information of the warm-up information. Also, it performs operation-controlling that drives the engine of ejection roller 45 corresponded to the discharging destination information of the warm-up information. Also, it performs operation-controlling that sets up the temperature of fixing part 66 by the paper size of paper P set to feeding part 41. Also, it performs control that set up the developing bias of image formation part 64, or the like, by the blank information and color information of the warm-up information.

(Step S206)

Next, control part 7 determines whether the cancel report of the printing request is input from operation part 5. If the cancel report is inputted (Yes in Step S206), it progresses to Step S207. If the cancel report is not inputted (No in Step S206), it progresses to Step S209.

(Step S207)

Next, control part 7 performs the instructions that cancels the setup state of print engine to print engine control processing part 71.

(Step S208)

Next, print engine control processing part 71 cancels the setup state of the print engine, which has been the setup state.

(Step S209)

Next, control part 7 detects completion of the setup of print engine from print engine control processing part 71.

(Step S210)

Next, control part 7 starts printing executive operation part 72.

(Step S211)

Next, printing executive operation part 72 picked out paper P from feeding part 41 based on the print setting information inputted at Step S201, and it performs a print operation, which transfer part 65 makes transfer a toner image to paper P, fixing part 66 heats paper P, and the toner image is fixed to paper P.

(Step S212)

Next, control part 7 discharges paper P, which the toner is fixed, to ejection space 46 by ejection roller 45.

As mentioned above, in the second embodiment, for the image forming apparatus of low cost that a paper does not stop in the registration roller position, when a printing request is canceled, the setup state of print engine is canceled. Thereby, power consumption can be suppressed. Also, a lifetime can be prolonged by preventing wear of print engine.

The invention claimed is:

1. An image forming apparatus that a paper does not stop in a registration roller position, comprising:

a resist position roller that is set at the registration roller position and has no resist function to specify timing for paper feeding from one of a sheet paper cassette and a paper feed tray;

wherein the resist position roller is directly linked with a actuator of a feed roller, and is controlled by the actuator that drives the feed roller;

a print engine control circuit that controls operation of a print engine; and a warm-up information preparing circuit that makes warm-up information before the paper feeding from one of the sheet paper cassette and the paper feed tray;

wherein the print engine control circuit sets up, before the paper feeding from one of the sheet paper cassette and the paper feed tray, the print engine based on the warm-up information made by the warm-up information preparing circuit;

wherein the warm-up information includes feeding paper source information, discharging destination information, blank information, and color information;

wherein the warm-up information includes information for performing a setup a printing part including a photo conductor drum, a charging device, an exposure device, an image formation device, a transfer device, a fixing device, a cleaning device, and an actuator of a roller;

wherein, after the print engine is notified of the warm-up information, the print engine is notified of information not regarding a drive of the printing part or rollers in the image forming apparatus; and wherein the information not regarding a drive of the printing part or rollers includes post conditioning information, count-up information, and charging information.

2. The image forming apparatus according to claim 1, further comprising a printing executive operation circuit that performs print operation, wherein when completion of the warm-up of the print engine control circuit is detected, the printing executive operation circuit performs print operation.

3. The image forming apparatus according to claim 1, further comprising:

a cancel input circuit that inputs cancel for a printing request;

a cancel input determining circuit that determines the cancel is input, wherein when determining input the cancel by the cancel input determining circuit, the print engine control circuit cancels a setup state of the print engine, which is set up based on the warm-up information made by the warm-up information preparing circuit before the paper feeding from one of the sheet paper cassette and the paper feed tray.

4. An image forming apparatus that a paper does not stop in a registration roller position, comprising:

a resist position roller that is set at the registration roller position and has no resist function to specify timing for paper feeding from one of a sheet paper cassette and a paper feed tray;

wherein the resist position roller is directly linked with a actuator of a feed roller, and is controlled by the actuator that drives the feed roller;

a print engine control circuit that controls operation of a print engine;

a warm-up information preparing circuit that makes warm-up information before the paper feeding from one of the sheet paper cassette and the paper feed tray;

wherein the print engine control circuit sets up, before the paper feeding from one of the sheet paper cassette and the paper feed tray, the print engine based on the warm-up information made by the warm-up information preparing circuit;

wherein the warm-up information includes feeding paper source information, discharging destination information, blank information, and color information;

wherein the warm-up information includes information for performing a setup a printing part including a photo conductor drum, a charging device, an exposure device, an image formation device, a transfer device, a fixing device, a cleaning device, and an actuator of a roller;

wherein, after the print engine is notified of the warm-up information, the print engine is notified of- information not regarding a drive of the printing part or rollers in the image forming apparatus; and wherein the information not regarding a drive of the printing part or rollers includes post conditioning information, count-up information, and charging information;

a cancel input circuit that inputs cancel for a printing request; and a cancel input determining circuit that determines the cancel is input, wherein when determining input the cancel by the cancel input determining circuit, the print engine control circuit cancels a setup state of the print engine set up based on the warm-up information made by the warm-up information preparing circuit before the paper feeding from one of the sheet paper cassette and the paper feed tray.

5. The image forming apparatus according to claim 4, further comprising a printing executive operation circuit that performs print operation, wherein when determining not input cancel by the cancel input determining circuit, the printing executive operation circuit performs the print operation.

6. An image formation method performed by an image forming apparatus that a paper does not stop in a registration roller position, wherein the image forming apparatus includes a resist position roller that is set at the registration roller position and has no resist function to specify timing for paper feeding from one of a sheet paper cassette and a paper feed tray, and wherein the resist position roller is directly linked with a actuator of a feed roller, and is controlled by the actuator that drives the feed roller, the method comprising:

controlling operation of a print engine;

making warm-up information before the paper feeding from one of the sheet paper cassette and the paper feed tray;

setting up the print engine, before the feeding from one of the sheet paper cassette and the paper feed tray, based on the warm-up information; and after the print engine has been notified of the warm-up information, notifying the print engine of information not regarding a drive of a printing part or rollers in the image forming apparatus;

wherein the warm-up information includes feeding paper source information, discharging destination information, blank information, and color information;

wherein the warm-up information includes information for performing a setup the printing part including a photo conductor drum, a charging device, an exposure device, an image formation device, a transfer device, a fixing device, a cleaning device, and an actuator of a roller; and wherein the information not regarding a drive of the printing part or rollers includes post conditioning information, count-up information, and charging information.

* * * * *